US006905306B2

(12) United States Patent
Engländer et al.

(10) Patent No.: US 6,905,306 B2
(45) Date of Patent: Jun. 14, 2005

(54) MECHANICAL KINETIC VACUUM PUMP WITH ROTOR AND SHAFT

(75) Inventors: Heinrich Engländer, Linnich (DE); Michael Froitzheim, Dormagen (DE)

(73) Assignee: Leybold Vakuum GmbH, Cologne (DE)

( * ) Notice: Subject to any disclaimer, the term of this patent is extended or adjusted under 35 U.S.C. 154(b) by 0 days.

(21) Appl. No.: 10/415,028

(22) PCT Filed: Aug. 29, 2001

(86) PCT No.: PCT/EP01/09912

§ 371 (c)(1),
(2), (4) Date: Apr. 23, 2003

(87) PCT Pub. No.: WO02/35099

PCT Pub. Date: May 2, 2002

(65) Prior Publication Data

US 2004/0096311 A1 May 20, 2004

(30) Foreign Application Priority Data

Oct. 28, 2000 (DE) ..... 100 53 663

(51) Int. Cl.[7] ..... F01D 1/02
(52) U.S. Cl. ..... 415/200; 416/241 R
(58) Field of Search ..... 416/241 R; 415/90, 415/143, 200; 417/423.4

(56) References Cited

U.S. PATENT DOCUMENTS 2,441,432 A 5/1948 McGee ..... 230/134
4,812,278 A * 3/1989 Natori et al. ..... 264/221
5,022,455 A 6/1991 Takeda et al. ..... 164/46
5,073,207 A 12/1991 Faure et al. ..... 148/2
5,074,747 A 12/1991 Ikegami et al. ..... 415/55.1
5,480,299 A 1/1996 Motomura et al. ..... 432/176
5,524,699 A * 6/1996 Cook ..... 164/97
5,902,546 A * 5/1999 Kawasetsu et al. ..... 420/528
5,925,315 A * 7/1999 Bourkhina ..... 420/530
6,059,902 A * 5/2000 Yoshihara et al. ..... 148/550
6,077,363 A * 6/2000 Heymes et al. ..... 148/417
6,089,843 A * 7/2000 Kondoh ..... 418/179
6,287,361 B1 * 9/2001 Hauptmann et al. ..... 75/249
6,544,357 B1 * 4/2003 Hehmann et al. ..... 148/420
6,599,084 B1 * 7/2003 Schutz et al. ..... 415/90

* cited by examiner

*Primary Examiner*—Edward K. Look
*Assistant Examiner*—James M. McAleenan
(74) *Attorney, Agent, or Firm*—Fay, Sharpe, Fagan, Minnich & McKee, LLP

(57) ABSTRACT

A mechanical kinetic vacuum pump with a stator (1), a rotor (6, 7) made from an aluminum or magnesium alloy and a rotor (6, 7) and a bearing shaft (3). The shaft (3) and the rotor (6, 7) are connected by a shrink- or screw-fit in a secure permanent connection. The rotor (6, 7) is made by spray forming. The main alloying component in the aluminum or magnesium alloy is silicon which is present in an amount such that the alloy has an expansion coefficient which essentially corresponds to the expansion coefficient of the shaft material.

14 Claims, 1 Drawing Sheet

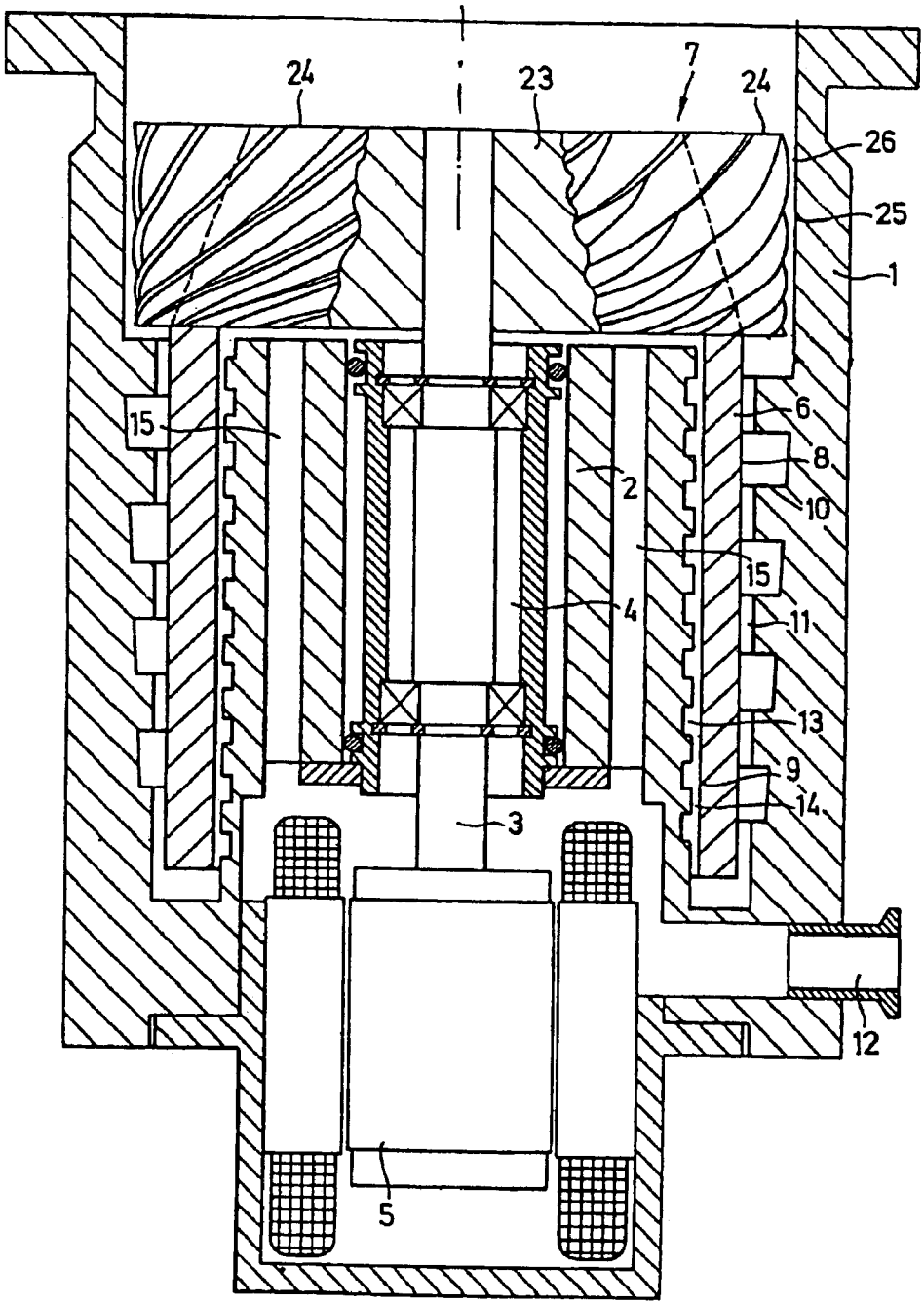
24
23
7
24
26
25
1
15
6
8
2
10
15
4
11
13
9
14
3
12
5

MECHANICAL KINETIC VACUUM PUMP WITH ROTOR AND SHAFT

BACKGROUND OF THE INVENTION

The present invention relates to mechanical kinetic vacuum pumps. It finds particular applications to vacuum pumps in which the rotor and stator are connected by a shrink-fit or a screw-fit.

By definition gaseous ring vacuum pumps, turbo vacuum pumps (axial, radial) and molecular/turbomolecular pumps belong to the class of mechanical kinetic vacuum pumps. They are capable of mechanically transporting within the molecular flow range (pressures below $10^{-3}$ mbar) the gas particles which are to be pumped. Moreover, molecular pumps are also capable of pumping gases within the Knudsen flow range ($10^{-3}$ to 1 mbar). Presently employed mechanical kinetic vacuum pumps frequently offer a turbomolecular pumping stage and a downstream molecular pumping stage (compound or hybrid pump), since such pumps are capable of compressing gases up in to the viscous flow range.

Pumps of the kind affected here, in particular turbomolecular vacuum pumps are operated at high rotational speeds up to 100,000 rpm. This requires a firm and tight joint between rotor and shaft which meets the requirements regarding rotor dynamics when passing through critical speeds. The joint commonly is provided by a shrink- or screw-fit. The shrink-fit joint is provided by joining the warm rotor and the cooled shaft, in that the shaft is introduced into a bore in the rotor. Generally steel is employed as the material for the shaft, since steel has a relatively high modulus of elasticity. For reasons of rotor dynamics a lighter material, preferably aluminium, is employed as the rotor material. Here aluminium alloys produced by melt metallurgy, e.g., casting, are well proven. However, in the instance of the material pair of steel/aluminium it is difficult to implement a joint between rotor and shaft which is free of backlash and settling since the coefficients of expansion of steel (about $11\times10^{-6}$/K) and aluminium (about $22\times10^{-6}$/K) differ.

From U.S. application Ser. No. 09/937,876, it is known to achieve freedom from backlash and settling at the joint between rotor and stator by providing reinforcement rings preventing an expansion of the aluminium rotor which would give rise to backlash. These measures are involved engineering-wise.

SUMMARY OF THE INVENTION

It is the task of the present invention to create a mechanical kinetic vacuum pump in which a firm joint between shaft and rotor is attained by more simple means.

This task is solved by alloying the rotor to have an expansion coefficient which essentially corresponds to the expansion coefficient of the shaft.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

The FIGURE is a side-sectional view of a vacuum pump in accordance with the present invention.

DETAILED DESCRIPTION OF THE PREFERRED EMBODIMENTS

Aluminium alloys produced through powder metallurgy (for example, through spray forming) are basically known in other applications. These are manufactured such that the melt consisting of the alloy's constituents is sprayed by nozzles on to a cold surface. Compared to the melt metallurgical manufacture of aluminium materials, e.g., casting, the melt solidifies very rapidly through which the alloy attains a new structure with changed properties. Aluminium alloys manufactured by spray forming, with the principal constituent being silicon, may be so adjusted that their coefficient of expansion corresponds to that of steel.

In that there is no or only a slight difference between the coefficients of expansion of shaft and rotor, loosening of the shrink-fit joint between shaft and rotor under the influence of temperatures in the operational state is prevented. Equally a joint offering a reduced shrink-fit tension may be manufactured which is easier to join and which incurs less strain on the material. Also, the bore and shaft can be manufactured with greater tolerances which—just like the more simple joining process—causes manufacture to be less involved and thus less costly.

The present invention shall be explained in the following with reference to the pump of the kind affected here depicted in the FIGURE. The pump depicted has an outer housing 1 with a central bearing sleeve 2 penetrating inside the housing. The bearing sleeve 2 supports the shaft 3 by means of a spindle bearing arrangement 4. Drive motor 5 and the rotor system 6, 7 are linked by shaft 3.

The single-piece rotor has two rotor sections 6 and 7 differing in design. Rotor section 6 is cylindrical in shape with a smooth outer and inner surface 8, 9. In the area of the surface 8, the housing 1 is equipped on its inside with a thread 10, thus at the same time forming the stator of a screw pumping stage. The surface 8 and the thread 10 are the active pumping surfaces of a screw pumping stage which is basically known and which pumps molecules entering into the pumping slot 11 towards the direction of the outlet 12.

In the area of the inner surface 9 of the rotor section 6 the outside of the bearing sleeves 2 is equipped with a thread 13 and thus forms the stator of a further screw pumping stage. The thread 13 and the inner surface 9 are the active pumping surfaces of the further screw pumping stage with the pumping slot 14. The gases being pumped from the bottom to the top through pumping slot 14 flow to the outlet 12 through bores 15 in the bearing sleeve 2.

Located upstream of the screw pumping stage 8, 10 is a further pump stage. This has a rotor section 7 which consists of a cone-shaped hub component 23 and the ridges or vanes 24. These ridges 24 form, with the stator wall 25 surrounding them in housing 1, a pump stage 7, 25. Gas molecules entering between the individual ridges 24 or into the slot 26 are pumped by the pump stage 24, 25 in the direction of pumping slot 11 of the molecular pumping stage 6, 10.

The shaft 3 carries the rotor section 7 which in turn carries the rotor section 6. The cylindrically shaped rotor section 6 may, but not must, consist of the same material as for rotor section 7. The employment of cylinder sections containing carbon fibres, for example, in the rotors of molecular pumps is also possible. The joint between shaft 3 and rotor section 7 is produced by a shrink-fit.

If the shaft 3 is fabricated of steel and the rotor system 6, 7—or at least rotor section 7—is fabricated of the alloy in agreement with the present invention, then the coefficients of expansion of shaft 3 and rotor 6, 7 are equal or almost equal. Even in the instance of high temperature loads on the rotor, which occur in particular when employing the pumps affected here in the semiconductor industry, a secure joint of rotor and shaft is ensured.

Materials of the types according to the present invention are being offered on the market under the names of DISPAL (DISPAL A/S 230, DISPAL S241, A and S 250, for example). Besides aluminium they contain 16 to 22 percent in weight silicon as the main constituent as well as other alloy constituents like iron, nickel, copper, magnesium, and/or zircon at shares of between 0.3 and 8 percent in weight.

In a material of comparable properties, a different light material namely magnesium may be present instead of the aluminium base material. Thus the advantage detailed for alloys based on powder metallurgy may be also utilised for alloys based on magnesium. The coefficient of expansion may be adjusted through suitable additional constituents like Si, for example.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. A mechanical kinetic vacuum pump including:

a stator, a rotor spray formed from an aluminum alloy, a bearing shaft made of a shaft material, the bearing shaft connected directly to the rotor with a shrink fit connection, the aluminum having a main alloying component of silicon in an amount such that the rotor has an expansion coefficient which essentially corresponds to an expansion coefficient of the shaft material.

2. The pump according to claim 1, wherein the silicon is present in the alloy in amounts of 16 to 22 percent by weight.

3. The pump according to claim 1, wherein the rotor material contains further alloy constituents, including at least one of iron, nickel, copper and zirconium.

4. A mechanical kinetic vacuum pump comprising:

a rotor made of one of a magnesium alloy and an aluminum alloy and manufactured by powder metallurgy;

a rotor shaft; and a shrink-fit connection connecting the rotor to the shaft.

5. The pump according to claim 4 wherein the rotor alloy includes silicon present in an amount such that the rotor alloy has an expansion coefficient which is the same as an expansion coefficient of steel.

6. The pump according to claim 5 further wherein the rotor shaft is steel.

7. The pump according to claim 5 wherein the rotor alloy further includes at least one of iron, nickel, copper, and zirconium.

8. A method of manufacturing a mechanical kinetic vacuum pump, the method comprising:

spray forming a light metal alloy into a rotor, the rotor including a central bore;

at least one of heating the rotor and cooling a rotor shaft to create a thermal difference therebetween;

inserting the rotor shaft into the rotor bore such that as the rotor and the shaft are brought into thermal equilibrium, the rotor central bore shrinks relative to the shaft forming a shrink-fit interconnection;

fitting the rotor with the interconnected rotor shaft into a stator.

9. The method according to claim 8 wherein the light metal alloy is one of an aluminum alloy and a magnesium alloy.

10. The method according to claim 9 wherein the alloy includes silicon in an amount such that the rotor has a common expansion coefficient with the shaft.

11. The method according to claim 10 wherein the shaft is steel.

12. The method according to claim 11 wherein the silicon is present in an amount of 16 to 20% by weight.

13. The method according to claim 10 wherein the alloy further includes at least one iron, nickel, copper, and zirconium.

14. A mechanical kinetic vacuum pump manufactured by the method of claim 8.

* * * * *